United States Patent [19]

Davis

[11] Patent Number: 4,936,325

[45] Date of Patent: Jun. 26, 1990

[54] METHOD AND APPARATUS FOR APPLYING AND BLENDING IN EYE SHADOW

[76] Inventor: Audrey Davis, 2708 Victoria Dr., Picayune, Miss. 39466

[21] Appl. No.: 274,316

[22] Filed: Nov. 21, 1988

[51] Int. Cl.[5] ..... A45D 40/30

[52] U.S. Cl. ..... 132/319; 132/216

[58] Field of Search ..... 132/216, 218, 319, 320

[56] References Cited

U.S. PATENT DOCUMENTS

| | | | |
|---|---|---|---|
| 1,812,425 | 6/1931 | Wosse | 132/216 |
| 2,435,516 | 2/1948 | Samson | 132/216 |
| 2,917,058 | 12/1959 | Ferrar | 132/216 |
| 2,998,821 | 9/1961 | Hurdel | 132/218 |
| 3,266,500 | 8/1966 | Weld | 132/320 |
| 3,485,251 | 12/1969 | Brunet | 132/216 |

FOREIGN PATENT DOCUMENTS

WO87/02229 4/1987 PCT Int'l Appl. ..... 132/216

*Primary Examiner*—John Weiss
*Assistant Examiner*—Frank A. LaViola, Jr.
*Attorney, Agent, or Firm*—Shlesinger & Myers

[57] ABSTRACT

A method and apparatus for applying and blending on a human upper eyelid various shades of one or more of eye shadows. The method includes applying two or more shades in individual segments on the upper eyelid and blending in all together. The apparatus is made of a flexible material, and includes a cut-out section and a recess section separated by a thin partition wall for applying various shades of eye shadows therethrough. The device is contoured to fit within the bone structure above the eye of a person and includes holding flaps with pressure-sensitive adhesive back-layers for temporarily securing it on the face of the person. Two markings are provided for aligning the device with the outer curvature of the upper eyelid of the user.

11 Claims, 2 Drawing Sheets

FIGURE 1
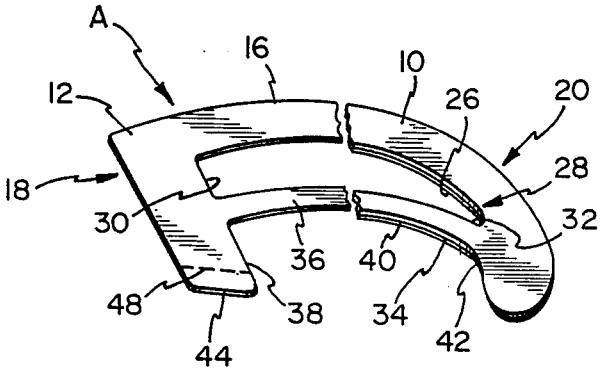
FIGURE 2
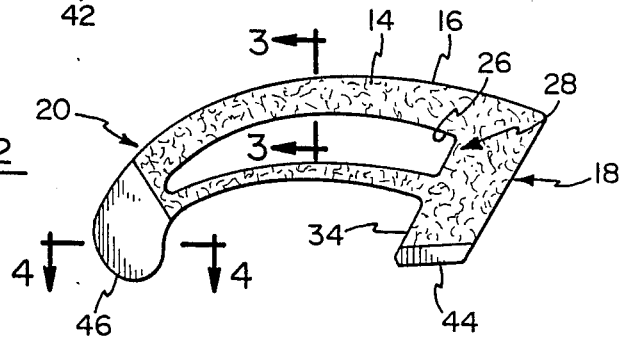
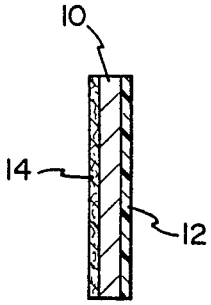
FIGURE 3
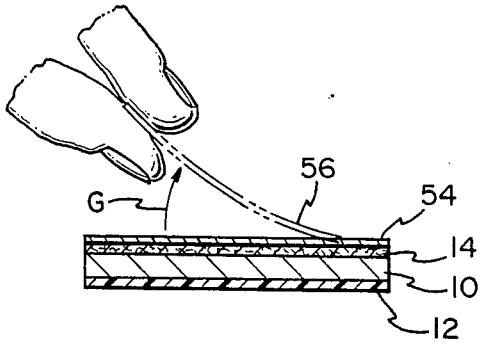
FIGURE 4
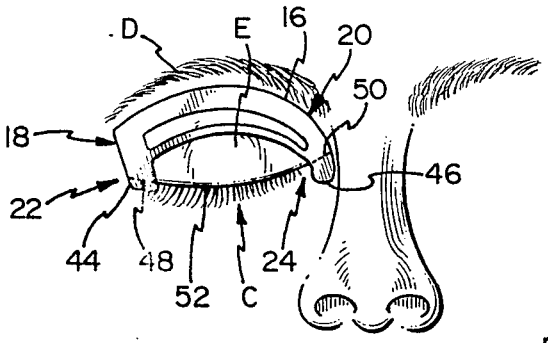
FIGURE 5

METHOD AND APPARATUS FOR APPLYING AND BLENDING IN EYE SHADOW

FIELD AND HISTORICAL BACKGROUND OF THE INVENTION

The present invention is directed to a method and apparatus for applying and blending on a human upper eyelid various shades of one or more eye shadows.

One of the problems which has been faced by women during the application of their overall facial make-up is the application of many shades of eye shadows quickly and in proper blend which gives a beautiful look after each application. Conventionally, various shades of one or more of eye shadows are applied on the upper eyelid by a brush, and by trial and error a proper blend of different colors is achieved. However, due to the small area of application and the fact that several shades may be involved in coloring the upper eyelid, it becomes increasingly difficult to obtain an even and perfect blend of eye shadow after each application. This is especially true of first-time make-up users and teenagers who are relatively inexperienced in the use of cosmetics.

Some of the make-up application devices are disclosed in U.S. Pat. Nos. 1,812,425; 2,917,058; 2,435,516; and Des. 101,593. However, these devices are directed to coloring eyebrows with the aid of a stencil type of device.

Therefore, there is a need for a method and apparatus which would assist a person in applying and blending various eye shadows quickly and efficiently to bring about a desired and beautiful blend of various shades thereof in each application.

OBJECTS AND SUMMARY OF THE INVENTION

The principal object of the present invention is to provide a method and apparatus for applying and blending various shades of eye shadows on the upper eyelid as a part of the overall facial make-up.

One object of the present invention is to provide a method which assists a person in applying various shades of eye shadow on the upper eyelids as a part of the overall facial make-up.

Another object of the present invention is to provide an eye shadow pattern outliner apparatus which is made of a light-weight flexible material and is contoured to fit within the bone structure above an eye of the user.

Yet another object of the present invention is to provide an eye shadow pattern outliner apparatus which is durable, reliable, easy to manufacture, and can be used conveniently and safely and with great speed in applying various shades of different eye shadows during overall facial make-up.

It is yet another object of the present invention to provide an eye shadow pattern outliner apparatus which may be used in training the beginners to apply various shades of eye shadows on the upper eyelid as a part of the overall facial make-up.

Still another object of the present invention is to provide an eye shadow pattern outliner apparatus which enables a person to apply and blend in various shades of eye shadows easily and conveniently to produce an improved upper eyelid appearance.

In summary, the main objective of the present invention is to provide a method and apparatus for coloring an upper eyelid as a part of the overall facial make-up.

BRIEF DESCRIPTION OF THE DRAWINGS

The above and other objects and advantages and novel features of the present invention will become apparent from the following detailed description of the preferred embodiment of the invention illustrated in the accompanying drawings, in which:

FIG. 1 is a perspective view of the apparatus of the present invention;

FIG. 2 is a bottom plan view thereof;

FIG. 3 is an enlarged view taken along line 3—3 of FIG. 2;

FIG. 4 is an enlarged view taken along line 4—4 of FIG. 2;

FIG. 5 partially shows the face of a person with the apparatus of the present invention placed over the right eye;

DETAILED DESCRIPTION OF THE INVENTION

Figure 6:
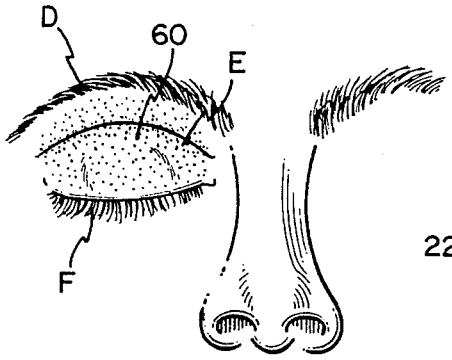
FIG. 6 shows the face of the person without the apparatus of the present invention and with one shade of eye shadow applied on the right upper eyelid.

As shown in FIGS. 1-5, the outliner apparatus for applying and blending eye shadow, generally indicated at A, is formed of a light-weight flexible material which is contoured to fit within the bone structure above eye C of a person (FIG. 5). More specifically, apparatus A is a composite piece having a central base sheet 10 made of a paper-like material, a generally shiny front sheet 12, and a cushiony back sheet 14 (FIG. 3). The contour of apparatus A includes upper curvilinear edge 16, which generally corresponds to the bone structure underlying eyebrow D of the person (FIG. 5), a wider left end 18 and a narrow right end 20. As shown in FIG. 5, ends 18 and 20 lie adjacent to outer and inner corners 22 and 24 of eye C, respectively, when placed on the eyelid E. Although, the apparatus has been shown in the drawings generally to fit over the right eye of a person, it would be clear to those of ordinary skill in the art that another apparatus can be made to fit over the left eye of the person, which would be a mirror image of the one shown herein.

As shown in FIG. 1, cut-out 26 having a perimeter and defining a first shadow application opening 28, is provided to allow the user to apply eye shadow therethrough. The opening 28 is also curvilinear and runs generally parallel to the contour of upper edge 16. The cut-out section has a wider left end 30 and a narrow right end 32 which lie adjacent wider and narrow ends 18 and 20 of the apparatus. The apparatus further includes recess section 34, which defines the lower external periphery thereof, and lies below cut-out section 26 and is separated therefrom by a thin, partition 36. The recess section or second shadow application opening 34 is generally C-shaped and bordered by three peripheral lines segments 38, 40, and 42 (FIG. 1).

The cut-out section 28 and recess section 34 (first and second shadow application openings, respectively) expose almost the entire upper eyelid E, except for the area underlying partition wall 36, but allow the user to apply two different shaped shades of the eye shadow in segments over the upper eyelid, clearly separated from each other due to the presence of the wall 36. Therefore, the partition wall functions to separate the two shades of the eye shadow that are applied by the user. The area of each of the openings is consequently much less than the area of the eyelid to receive the eye shadow. Upon removal of the apparatus from the eyelid, the user may blend in these two adjacent shades of the eye shadow to produce a desired color blend.

As best shown in FIGS. 1 and 5, the apparatus is further provided with finger tip engageable holding tabs or holding flaps 44 and 46 which extend generally downwardly from ends 18 and 20, respectively. Either one or both of the holding tabs or flaps has a peripheral surface which defines the periphery of one of the openings. Holding flaps 44 and 46 are also made of same material as the apparatus and are foldable about alignment markings 48 and 50 provided on front sheet 12. Holding flap 46 engages the side of the nose. As shown in FIG. 5, markings 48 and 50 align with outer curvature 52 of upper eyelid E.

As shown in FIG. 4, holding flaps 44 and 46 may be provided with a pressure sensitive adhesive 54 on their undersurface. The adhesive 54 is protected by a thin backing layer 56 which can be easily removed by the user before placing the apparatus on the face, shown by arrow G in FIG. 4.

The back sheet 14 may preferably be made of a material which imparts strength, flexibility, and resilience to the apparatus, and which is durable and comfortable in touch. Some examples include soft plastic and elastic like material, wool, nylon, Cotton, silk, rayon, etc. Similarly, central base sheet 10 may alternatively be made of a plastic or elastic like material, in which case there may be no need to provide a front sheet 12. The overall appearance of the outliner may be improved by making front sheet 12 in one color or several colors, or by placing various attractive designs thereon.

USE AND OPERATION

Figure 7:
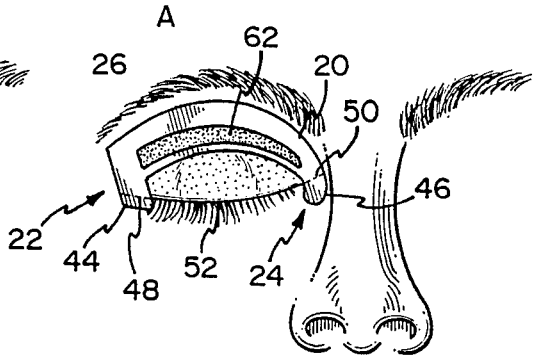
FIG. 7 shows the face of the person with the apparatus of the invention in position, wherein a second shade of the eye shadow has been applied on the upper eyelid through the cut-out section of the apparatus.

In use, the user first applies a base shade 60 of an eye shadow on upper eyelid E from eyebrow D to eyelash F, (FIG. 6), and then places the apparatus A over upper eyelid E (FIG. 7). In placing the apparatus over the eyelid, narrow end 20 is placed adjacent the inside corner 24 of the eye such that marking 50 matches or is aligned with outer curvature 52 of the eyelid. The holding flap 46 is bent about marking 50 in order that it may rest on the nose bridge. Either before placing the apparatus A over eyelid E, or after, as may be convenient to the user, adhesive backing layer 56 is peeled -off such that the pressure sensitive adhesive 54 is exposed, and when holding flap 46 is pressed with a finger, the apparatus is temporarily held on the face. Similarly, marking 48 is aligned with outer corner 22 of the eye and holding flap 44 is likewise pressed such that the apparatus is securely held over eyelid E. It should be noted that it may be necessary to secure apparatus A over eyelid E by gently pressing holding flaps 44 and 46 by, for example, middle and index fingers.

Figure 8:
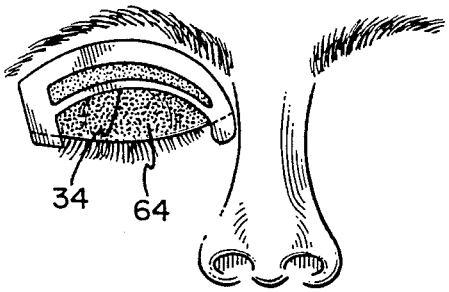
FIG. 8 shows the face of the person with the apparatus of the present invention, wherein a third shade of the eye shadow has been applied on the upper eyelid through the recess section located adjacent the eyelash.
Figure 9:
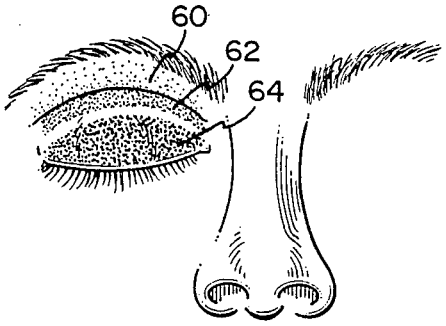
FIG. 9 shows the face of the person with the apparatus of the present invention removed, and showing first, second and third shades of the eye shadow on the eyelid.
Figure 10:
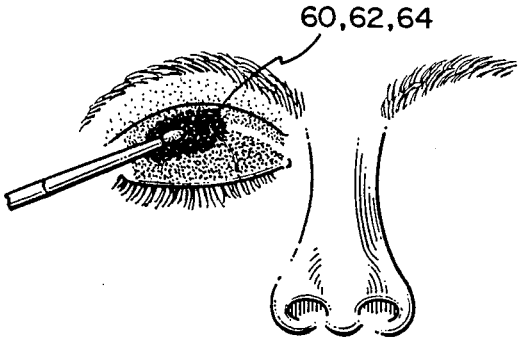
FIG. 10 shows the face of the person with the apparatus of the present invention removed, wherein the three shades of the eye shadows have been partially blended.
Figure 11:
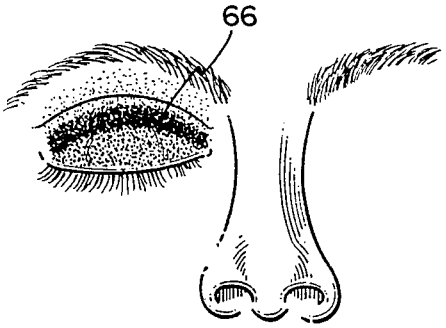
FIG. 11 shows the face of the person, wherein a fourth shade of the eye shadow has been applied and blended.

Once the apparatus is securely in place over the eyelid E, the user then applies a sufficient amount of first shade 62 of the eye shadow through cut-out section 26 such that the eyelid portion exposed therethrough is sufficiently covered with first shade 62 of the eye shadow (FIG. 7) A second shade 64 of the eye shadow is then applied over the eyelid area exposed through recess section 34 (FIG. 8). Thereafter, the apparatus A may gently be removed from the eyelid and, base, first, and second shades 60, 62 and 64, of the eye shadow are blended in all together (FIGS. 9 and 10). Finally, a blend shade 66 of the eye shadow from the same color family as shades 60, 62 and 64, maybe applied over the areas on which first and second shades were applied, and then gently blended all together in these areas (FIG. 11).

Although the present invention has been described in terms of applying various shades of one eye shadow, it is well within the scope of this invention to apply various shades of various eye shadows using the apparatus and the method of the present invention. In addition, it is also within the scope of the invention to use the claimed apparatus in a manner to color various sections of the upper eyelid with various shades of one or more of eye shadows. In other words, the user may choose not to blend in the eye shadows together and leave the eyelid painted with different colors.

It can be seen from the above, that the method and apparatus of the present invention can be used to apply various shades of one or more of eye shadows over the upper eyelid of a person quickly and effectively. The method and device are simple, easy to use and bring about effective results.

Although not shown, it is well within the scope of this invention to provide other means, devices which would enable a person to use the apparatus in a "hands-free" manner. For example, the apparatus may be modified to have the characteristics of a pair of glasses, wherein the user does not need to use the fingers to hold it on the face, and both left and right upper eyelids may be colored with a single apparatus.

While this invention has been described as having a preferred design, it should be understood that it is capable of further modifications. This application is therefore intended to cover any variations, uses, and/or adaptations of the invention following in general the principles of the invention and including such departures from the present disclosure as have come within known or customary practice in the art to which this invention pertains, and as may be applied to the essential features hereinbefore set forth and fall within the scope of this invention or the limits of the claims appended hereto.

What is claimed is:

1. A method of applying eye shadow on an eye lid, comprising the steps of:

(a) aligning an eye shadow outliner having first and second eye shadow application openings for guiding application of eye shadow on the lid;

(b) applying a first shade of the eye shadow through the first eye shadow application opening of said outliner;

(c) applying a second shade of the eye shadow through the second eye shadow application opening of said outliner; and (d) removing said outliner from the eye lid.

2. The method of claim 1, further comprising:

(a) applying a base shade of the eye shadow on the upper eyelid from eyebrow to eyelash prior to placing said apparatus thereon.

3. The method of applying eye shadow on a human upper eyelid as set forth in claim 1, including the step of:

(a) blending the first and second shades of the eye shadow over the eye lid to produce a mixed blend of the eye shadow.

4. The method of claim 3, further comprising:

(a) applying blend shade of the eye shadow over the first and second shades and blending it in all together.

5. An eye shadow pattern outliner positionable over a closed eye lid and within the bone structure above the eye, comprising: (p1 (a) a sheet of generally flexible material having an upper edge contoured to fit within the bone structure above an eye and to cover the eye lid of a user;

(b) said sheet including a shaped first opening spaced inwardly from the outer edges thereof through which a first shade of an eye shadow is applied to form a colored section on the eye lid generally corresponding to the shape of said first opening;

(c) said sheet including a shaped second opening positioned adjacent to said first opening through which a second color shade is applied to the eye lid to form a shape generally corresponding to the outline of said second opening;

(d) a thin partition wall separating said first and second openings;

(e) each opening being of less area than the area on the eye lid to be covered by eye shadow;

(f) finger tip engageable tab means for holding said sheet in position over the eye lid of the user; and (g) the finger tip engageable tab means including a tab having a portion thereof which forms a part of the periphery of one of said openings.

6. The eye shadow pattern outliner device of claim 5, wherein (a) said holding means includes a flap extending from a corner of said sheet, which is to contact and rest on the side of the bridge of the nose.

7. The outliner device of claim 6, wherein:

(a) said aligning means includes a marking provided generally at a junction of said flap and said corner of said sheet.

8. The outliner device of claim 6, further comprising:

(a) a pressure-sensitive adhesive layer disposed on one surface of said flap to enable said sheet to be removably held on the face of the user.

9. The eye shadow pattern outliner as set forth in claim 5, wherein:

(a) the finger tip engageable tab means includes a single tab at each end of the sheet; and (b) one of the tabs is engageable with the side of the nose.

10. The eye shadow outliner device of claim 5, wherein:

(a) said second opening is a recess section positioned below said cut-out section such that when said sheet is placed on the eye lid of the user, said first opening is adjacent to an eye brow and said recessed section is adjacent to an eye lash of the user.

11. The outliner device of claim 5, further comprising:

(a) a front sheet formed of a light plastic material; and (b) a back sheet formed of a soft cushion material.

* * * * *